US007467785B2

(12) United States Patent
Braun

(10) Patent No.: US 7,467,785 B2
(45) Date of Patent: Dec. 23, 2008

(54) AUXILIARY FUEL AND AIR SUPPLY IN A CARBURETOR

(75) Inventor: Matthew A. Braun, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 216 days.

(21) Appl. No.: 11/518,037

(22) Filed: Sep. 8, 2006

(65) Prior Publication Data

US 2008/0061454 A1 Mar. 13, 2008

(51) Int. Cl.
*F02M 7/08* (2006.01)

(52) U.S. Cl. ..... 261/34.2; 123/179.11; 261/35; 261/DIG. 8; 261/DIG. 21

(58) Field of Classification Search ..... 261/34.2, 261/35, DIG. 8, DIG. 21; 123/179.11
See application file for complete search history.

(56) References Cited

U.S. PATENT DOCUMENTS 4,335,061 A * 6/1982 Kobayashi ..... 261/44.8
5,554,322 A 9/1996 Kobayashi
6,000,369 A 12/1999 Koizumi
6,293,524 B1 9/2001 Endo et al.
6,374,810 B1 * 4/2002 Pattullo ..... 123/516
6,394,426 B1 5/2002 Galka et al.
6,481,403 B1 * 11/2002 Ashcraft et al. ..... 123/179.11
6,533,254 B1 * 3/2003 Grifka et al. ..... 261/35
2002/0195726 A1 * 12/2002 Galka et al. ..... 261/35

FOREIGN PATENT DOCUMENTS

JP 3-242455 A * 10/1991

* cited by examiner

*Primary Examiner*—Richard L Chiesa
(74) *Attorney, Agent, or Firm*—Reising, Ethington, Barnes, Kisselle, P.C.

(57) ABSTRACT

A carburetor includes a fuel and air mixing passage with a throttle valve therein, and a bore with a valve therein defining in part a valve actuation chamber and a separate fuel and air mixing chamber in communication with the fuel and air mixing passage at a location downstream of the throttle valve. A fuel passage and an air passage are in communication with the fuel and air mixing chamber. A purge apparatus is in communication with the valve actuation chamber and is operable to move the valve to an open position to open the fuel and air passages to the fuel and air mixing chamber such that a fuel and air mixture may flow from the fuel and air mixing chamber to the fuel and air mixing passage downstream of the throttle valve.

21 Claims, 4 Drawing Sheets

AUXILIARY FUEL AND AIR SUPPLY IN A CARBURETOR

FIELD OF THE INVENTION

This invention relates generally to engine fuel systems, and more particularly to a carburetor.

BACKGROUND OF THE INVENTION

A carburetor is typically used to supply a fuel and air mixture to two stroke and four stroke internal combustion engines. For many applications where small two stroke engines are used, such as hand held power chainsaws, weed trimmers, leaf blowers, garden equipment and the like, a carburetor with both a diaphragm fuel pump and a diaphragm fuel metering system are often used.

A so-called diaphragm carburetor generally includes a body having a mixing passage with an air inlet opening, and a fuel and air mixture outlet opening downstream of the air inlet opening. The diaphragm carburetor also typically includes a throttle valve disposed in the fuel and air mixing passage downstream of the air inlet opening for controlling delivery of a primary fuel and air mixture to the engine. A typical diaphragm fuel metering system includes a metering valve, and a flexible diaphragm carried by the body and partially defining and separating a fuel chamber from the atmosphere. The metering valve and diaphragm provide fuel from the diaphragm fuel pump to the fuel chamber for delivery from the fuel chamber to the fuel and air mixing passage. A manually actuated purge pump is also carried by the body in fluid communication with the diaphragm fuel pump and fuel chamber and has a flexible bulb that is depressed to purge the diaphragm fuel pump and fuel chamber of any air and fuel vapor and stale liquid fuel. The flexible bulb is actuated to a depressed state, thereby causing liquid fuel and any fuel vapor and air within the bulb to be directed out of the carburetor through a downstream fuel line to a fuel tank. The flexible bulb is then returned to a non-depressed state, thereby drawing liquid fuel and any fuel vapor and air into the bulb through an upstream fuel line. The purging is generally repeated as necessary to ensure that fuel vapor, air and stale liquid fuel is purged from the fuel pump and fuel chamber.

Some diaphragm carburetors are also configured to supply an auxiliary fuel and air mixture in addition to the primary fuel and air mixture. For example, the auxiliary fuel and air mixture may be provided downstream of the throttle valve for improved engine starting and initial running of the engine just after starting. Typically, the auxiliary fuel and air mixture is provided from the fuel chamber through auxiliary fuel and air conduits and is controlled by manually actuated control valves and associated levers or knobs. In operation, a user first manually depresses the bulb of the purge valve to purge the fuel pump and chamber of vapor and air, then manually actuates the manual control valve to open the auxiliary fuel and air conduit, and starts the engine such as by pulling a manual start pull cord or energizing an electric starter. Thereafter, the user may have to manually actuate the manual control valve to close the auxiliary fuel and air conduit.

Thus, the manual control valve and associated devices add components, complexity, and cost to the carburetor, and require separate manual valve actuation steps by an operator.

SUMMARY OF THE INVENTION

A carburetor with a fuel and air mixing passage having a throttle valve therein for controlling flow of fuel and air therethrough, also includes an auxiliary fuel and air supply apparatus for improved engine starting and initial engine running just after starting. A fuel and air mixing bore of the carburetor includes a valve disposed therein. The mixing bore and valve define a valve actuation chamber, and also define a separate fuel and air mixing chamber in communication with the fuel and air mixing passage at a location downstream of the throttle valve. A fuel passage is in communication with the fuel and air mixing chamber to supply fuel to the fuel and air mixing chamber. An air passage is in communication with the fuel and air mixing chamber to supply air thereto. A purge apparatus is in communication with the valve actuation chamber and is operable to pressurize the valve actuation chamber and thereby move the valve to an open position. When the valve is in the open position, the fuel and air passages may communicate with the fuel and air mixing chamber and fuel and air may flow from the fuel and air mixing chamber to a location in the fuel and air mixing passage downstream of the throttle valve.

At least some of the objects, features and advantages that may be achieved by at least certain embodiments of the invention include providing a carburetor with an auxiliary fuel and air supply apparatus that is automatically operable and does not require an operator to manually actuate a control valve to open or close a conduit of an auxiliary fuel and air supply apparatus, is compact, simple in operation, eliminates steps in engine starting, uses relatively few components, eliminates use of a conventional choke valve, enhances starting and warm up of an engine, supplies a relatively richer fuel and air mixture to an engine than normally supplied by a carburetor having a conventional choke valve, improves low speed stability of an engine, can be used with carburetor bodies originally designed for use with a conventional choke valve, and is of relatively simple design, economical manufacture and assembly, rugged, durable and reliable, and in service has a long useful life.

Of course, other objects, features and advantages will be apparent in view of this disclosure to those skilled in the art. Various other carburetors or engine fuel apparatus embodying the invention may achieve more or less than the noted objects, features or advantages.

BRIEF DESCRIPTION OF THE DRAWINGS

These and other objects, features and advantages of the present invention will be apparent from the following detailed description of preferred embodiments and best mode, appended claims, and accompanying drawings in which:

DETAILED DESCRIPTION OF PREFERRED EMBODIMENTS

Figure 1:
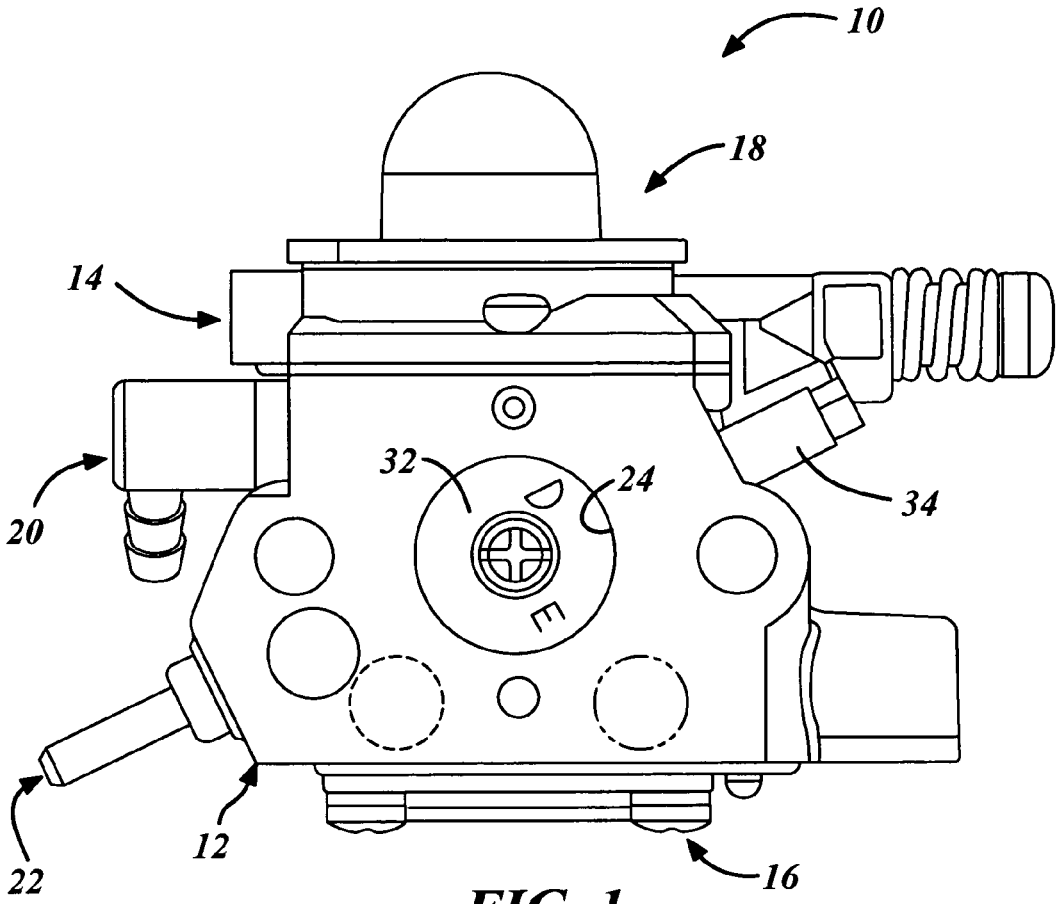
FIG. 1 is an end view of a presently preferred form of a carburetor embodying this invention.

Referring in more detail to the drawings, FIG. 1 illustrates a carburetor 10 for use with an internal combustion engine (not shown). The carburetor 10 includes a main body 12, a fuel pump assembly 14 for pumping liquid fuel, a fuel metering assembly 16 for metering desired amounts of liquid fuel into the main body 12, and a fuel purge apparatus 18 for purging the fuel pump assembly 14 and the metering assembly 16 of stale fuel and any fuel vapor and air. The carburetor 10 may be similar in many respects to that described in U.S. Pat. No. 6,293,524, which is assigned to the assignee hereof and is incorporated by reference herein in its entirety.

The main body 12 may be composed of any suitable material but is preferably composed of metal such as cast aluminum or the like. The main body 12 provides structural support for the aforementioned assemblies 14, 16, 18 and various other components and passages as will be described in further detail herein below. Externally, the main body 12 carries a fuel inlet fitting 20 for connection to a fuel tank and a fuel outlet fitting 22 for discharging purged fuel and any fuel vapor and air and preferably returning them to the tank.

Figure 2:
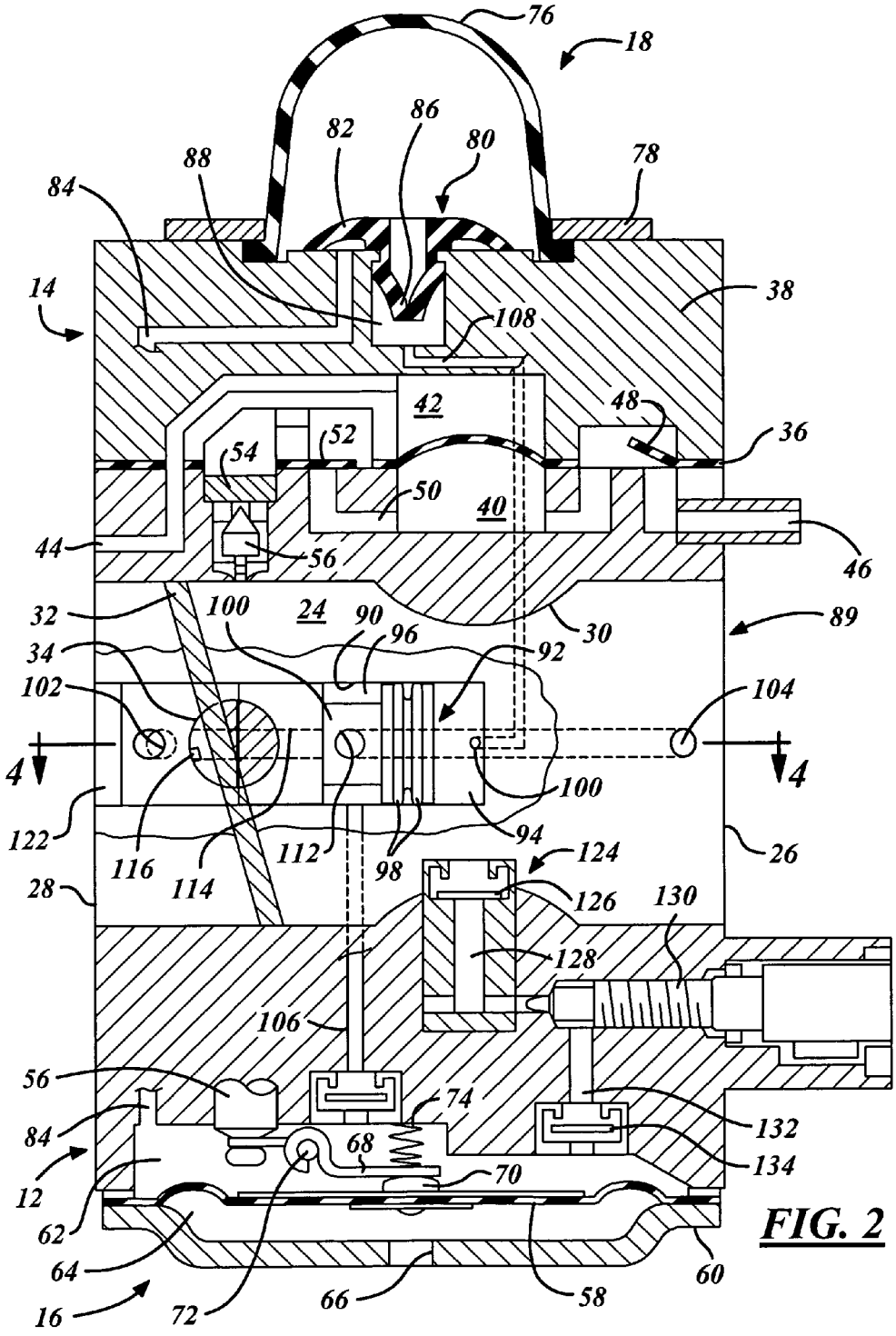
FIG. 2 is a cross-sectional view of the carburetor of FIG. 1.

Internally, and referring now to FIGS. 1 and 2, the main body 12 has a fuel and air mixing passage 24 with an air inlet 26 that may be in communication with an atmospheric air source such as an air filter (not shown) and a fuel and air mixture outlet 28 that may be in communication with an intake passage of the engine (not shown). The fuel and air mixing passage 24 preferably includes a venturi 30 downstream of the inlet 26 and upstream of the outlet 28. A throttle valve 32 is received in the mixing passage downstream of the venturi 30 and is mounted on a throttle shaft 34 extending transversely through the passage 24 and journalled for rotation in the main body 12.

As shown in FIG. 2, the fuel pump assembly 14 has a flexible membrane or diaphragm 36 received and sealed between an upper face of the main body 12 and a lower face of an upper cover 38. The diaphragm 36 defines part of a pump chamber 40, and part of a pulse chamber 42 to which pressure and vacuum pulses in a crankcase of the operating engine (not shown) are introduced through a pulse passage 44 to flex or actuate the diaphragm 36. Flexing of the diaphragm 36 toward chamber 42 draws liquid fuel from a fuel tank (not shown) through fitting 20, a fuel inlet passage 46, including a one-way check valve 48 therein, and into the pump chamber 40. Further flexing of the diaphragm 36 toward chamber 40 supplies the liquid fuel under pressure from the pump chamber 40 through a fuel outlet passage 50, including a one-way check valve 52 and a screen 54 therein, to the fuel metering system 16 and past its metering valve 56 when it is open.

As shown in FIG. 2, at the bottom of the carburetor 10, the fuel metering system 16 has a flexible membrane or diaphragm 58 received and sealed between a lower face of the main body 12 and a lower cover 60. The diaphragm 58 defines part of a fuel metering chamber 62 on one side of the diaphragm 58 and an atmospheric air chamber 64 on its other side. The air chamber 64 communicates with the atmosphere outside of the carburetor 10 through a port 66 in the lower cover 60. The metering valve 56 is opened and closed to control the admission of fuel to the fuel metering chamber 62 by movement of the diaphragm 58. The diaphragm 58 is operably connected to the metering valve 56 by a lever 68 connected adjacent one end to the metering valve 56 and adjacent the other end bears on a projection 70 attached to the center of the diaphragm 58 and between its ends is pivotally mounted on a support shaft 72. The metering valve 56 is yieldably biased to its closed position by a spring 74 bearing on the lever 68.

As shown in FIG. 2, the fuel chamber purge apparatus 18 includes a flexible rubber dome or purge bulb 76 attached and sealed to the upper cover 38 by a retainer plate 78. The purge bulb 76 encloses a mushroom-shaped purge valve assembly 80. The purge valve 80 includes an inlet or suction valve portion 82 communicating through a purge inlet passage 84 with an upper portion of the fuel metering chamber 62. The purge valve 80 also includes an outlet or discharge valve portion 86 communicating via a purge outlet chamber 88 and fitting preferably ultimately to an upper portion of the fuel tank (not shown) as will be described herein below with regard to an auxiliary fuel and air supply apparatus 89.

Figure 3:
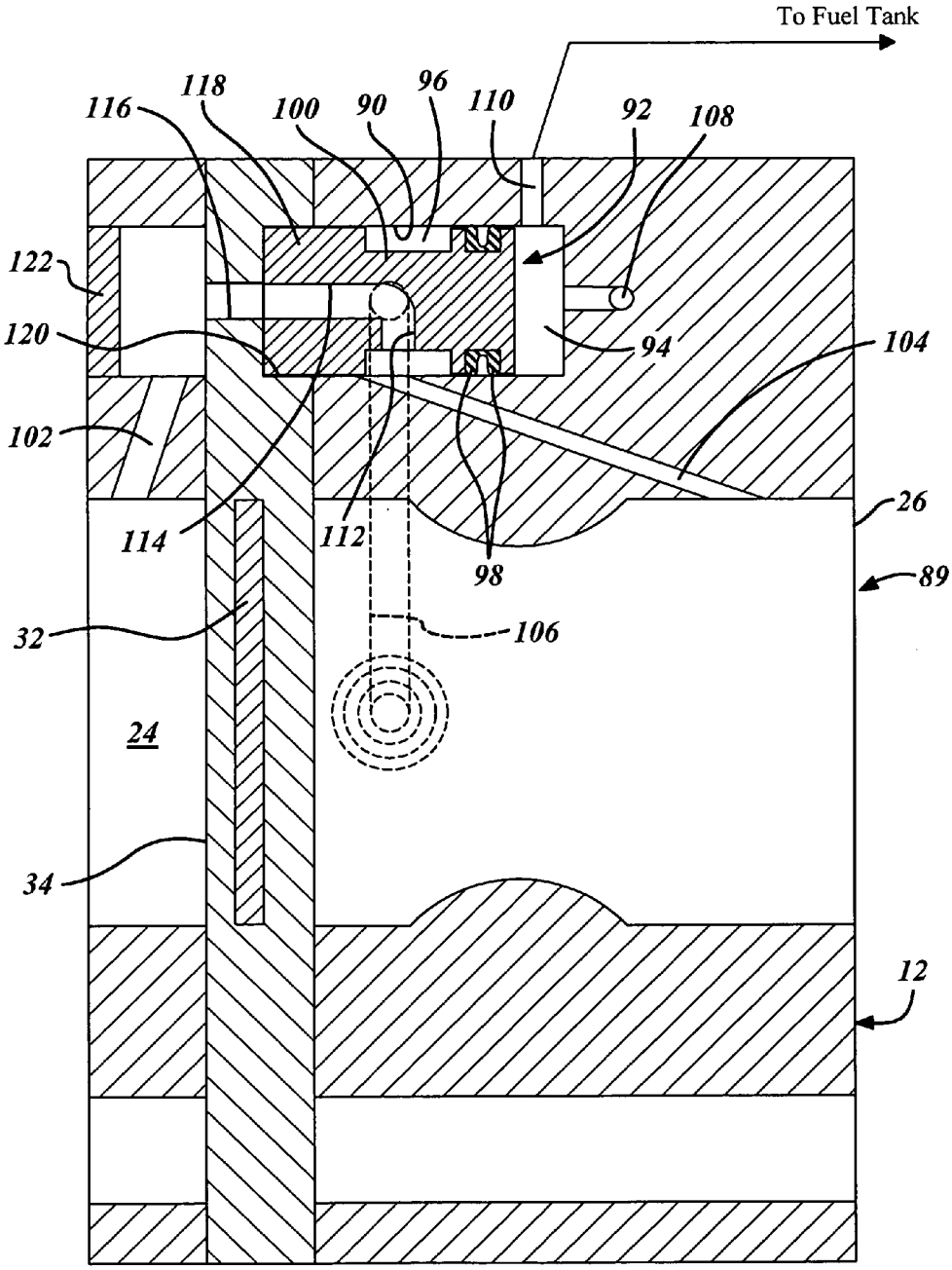
FIG. 3 is a sectional view of the carburetor taken along line 4-4 of FIG. 2, showing a valve in open or engine idle position.

As shown fragmented in FIG. 2, and in cross section in FIG. 3, the carburetor 10 includes the auxiliary fuel and air supply apparatus 89 for improved engine starting and initial running of the engine just after starting. The auxiliary fuel and air supply apparatus 89 supplies an auxiliary mixture of fuel and air downstream of the throttle valve 32, such as when the valve 32 is in its idle position. But when the throttle valve 32 is open, a primary mixture of fuel and air is supplied via the fuel and air mixing passage 24 upstream of the throttle valve 32.

The auxiliary fuel and air supply apparatus 89 preferably includes a bore 90, and an auxiliary fuel and air mixing piston or valve 92 disposed therein. The valve 92 at least partially defines a valve actuation chamber 94 and a fuel and air mixing chamber 96 separated from the actuation chamber 94 by a seal 98. The seal 98 is preferably an elastomeric quad seal on one end of a body 100 of the valve 92, opposite a head 118 connected to the body 100 of the valve 92. The seal 98 tends to hold the valve 92 in place by friction between the outer diameter of the seal 98 and the inner diameter of the fuel and air mixing bore 90. The fuel and air mixing chamber 96 is in communication with the fuel and air mixing passage 24 at a location downstream of the throttle valve 32, via a transversely-oriented mixed fuel and air outlet passage 102 and passages 116 and 114 through the throttle shaft 34 and valve 92 as will be described herein below.

The auxiliary fuel and air supply apparatus 89 also preferably includes a number of other passages. An air passage 104 includes an upstream end in communication with the fuel and air mixing passage 24 at a location upstream of the throttle valve 32, preferably at the air inlet 26 of the main body 12. The air passage 104 further includes a downstream end in communication with the fuel and air mixing chamber 96. A fuel passage 106 has an upstream end in communication with the fuel metering chamber 62 and a downstream end in communication with the auxiliary fuel and air mixing chamber 96. A purge outlet passage 108 has an upstream end in communication with the purge outlet chamber 88 of the purge apparatus 18 and a downstream end in communication with the valve actuation chamber 94. A return fuel passage 110 has an upstream end in communication with the valve actuation chamber 94 and a downstream end in communication with the outlet fitting 22 which preferably communicates with the fuel tank (not shown). The auxiliary fuel and air supply apparatus may also include the fuel chamber 62, the fuel chamber purge apparatus 18, and the throttle shaft 34.

In operation, the fuel chamber purge apparatus 18 may be manually actuated to expel any air, fuel vapor, and/or stale fuel from the fuel pump assembly 14 and fuel metering chamber 62 before starting the engine. In general, the bulb 76 of the fuel chamber purge apparatus 18 is actuated to a depressed state, thereby causing liquid fuel and fuel vapor within the bulb 76 to be expelled from therein, and the bulb 76 is then allowed to return to a non-depressed state, thereby drawing liquid fuel and any fuel vapor from the metering chamber 62 and fuel pump assembly 14 into the bulb 76. This manual purging is generally repeated as necessary.

Moreover, upon actuation of the fuel chamber purge apparatus 18, pressurized fluid flows from within the bulb 76 through the valve 86 and chamber 88, through the purge outlet passage 108 into the valve actuation chamber 94. Accordingly, with the throttle valve 34 in its idle position, the pressurized fluid effectively pressurizes the valve actuation chamber and thereby moves the fuel and air mixing valve 92 from a rest or closed position to an open or engine start up or idle position as shown in FIG. 3. Such movement of the valve 92 opens communication between the purge outlet passage 108 and the return fuel passage 110 so that fluid from the pump chamber 62 is purged from the carburetor 10 and preferably returned to the fuel tank (not shown). Such valve movement also opens communication between the fuel and air mixing passage 24 and the air and fuel passages 104, 106 by way of the fuel and air mixing chamber 96.

Accordingly, mixed air and fuel flow from the fuel and air mixing chamber 96, through a transverse passage 112 in the body 100 of the valve 92, through a longitudinal bore 114 in the head 118 of the valve 92, through a transverse passage 116 in the valve shaft 34, and through the mixed fuel and air outlet passage 102 in the main body 12 into the fuel and air mixing passage 24 downstream of the throttle valve 32. When the valve 92 is advanced in this way, and when the valve 32 and valve shaft 34 are in their idle position, the head 118 of the valve 92 fits into a notch 120 of the valve shaft 34. A plug 122 is preferably fit into the bore 90 to close it to force fluid flow through passage 102.

In addition to the auxiliary fuel and air supply apparatus 89, those of ordinary skill in the art will recognize that liquid fuel may also be supplied to a series of low speed fuel ports (not shown) which may open into the mixing passage 24 both upstream and downstream of the throttle valve 32 when in its idle or closed position. The low speed fuel may be supplied via a branch passage (not shown) in communication with passage 132, preferably an adjustable low speed fuel regulating needle valve (not shown), and a feeder passage (not shown) downstream of the low speed valve. Moreover, when the auxiliary fuel and air supply apparatus 89 is not used to supply fuel, such as when the throttle valve 32 is opened, liquid fuel may be supplied from the fuel metering chamber 62 through a primary fuel supply apparatus. The primary fuel supply apparatus can include a high speed fuel nozzle 124 opening into the mixing passage 24, a check valve 126, a passage 128, an adjustable fuel regulating needle valve 130, a passage 132, and a check valve 134.

A user may crank the engine associated with the carburetor 10, such as by pulling on a manual pull-starter cord (not shown) or activating an electric start apparatus (not shown). As the engine is cranked, movement of the engine piston(s) within the engine cylinder(s) creates a sub-atmospheric condition downstream of the throttle valve 32, and limited upstream air flow through the mixing passage 24. In turn, this causes liquid fuel and air to flow through the auxiliary fuel and air supply apparatus 89 into the mixing passage 24 downstream of the throttle valve 32 (in its idle position) and into the engine under startup idle and near idle operating conditions. The fuel and air supply via the auxiliary fuel and air supply apparatus 89 is provided to improve starting characteristics of the engine, particularly at low temperatures or for a "cold" engine. A pressure differential acts on the diaphragm 58 to open and close the metering valve 56 and thereby maintain a predetermined quantity of fuel in the metering chamber 62 and at a substantially constant pressure when the engine is operating. Accordingly, liquid fuel is supplied to the auxiliary fuel and air supply apparatus 89 and the high speed nozzle 124. Liquid fuel is also supplied to any low speed idle circuit (when the throttle valve is in its idle position).

Figure 4:
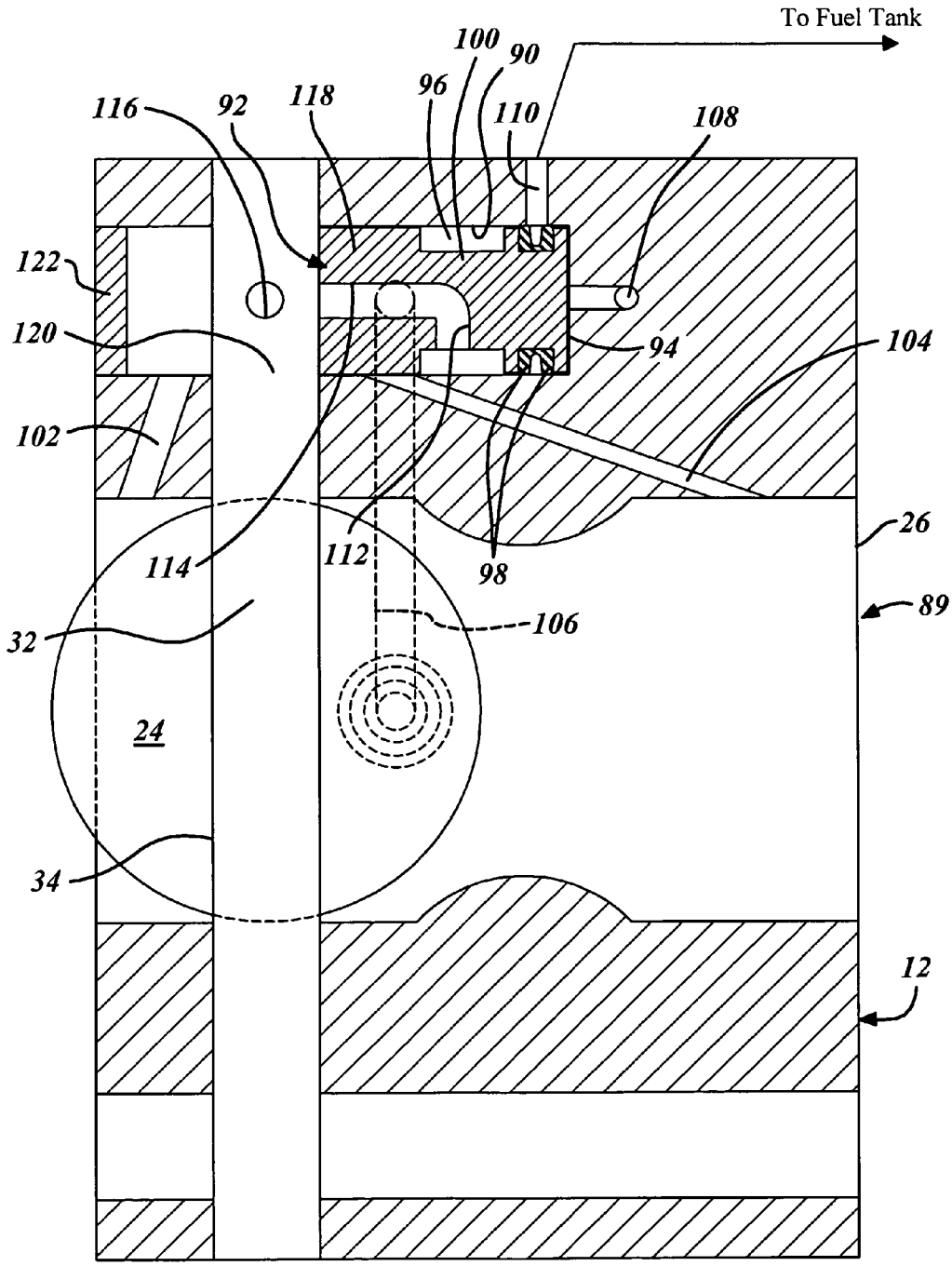
FIG. 4 is a sectional view of the carburetor taken along line 4-4 of FIG. 2, showing the valve in a rest or closed position.

After the engine is running, the engine may be accelerated by actuating or rotating the throttle valve 32 and its shaft 34. Rotation of the throttle valve 32 and shaft 34 causes cam slot 114 to move the fuel and air mixing valve 92 back to its rest position as shown in FIG. 4, thereby closing off communication between the purge outlet passage 108 and the return fuel passage 110, and also closing off communication between the fuel and air mixing passage 24 and the air and fuel passages 104, 106. Rotation of the throttle valve 32 and shaft 34 also further opens the mixing passage 24, and liquid fuel flows into the mixing passage 24 through the high speed nozzle 124, mixes with air and the mixture flows into the engine.

Thus, to start the engine, a user moves the throttle valve 32 to its idle position, and then depresses the bulb 76 of the purge valve apparatus 18 to purge the fuel pump 14 and fuel chamber 62 of any fuel vapor and air and stale fuel. Upon depressing the bulb 76, fluid under pressure flows through the purge outlet passage 108 and into the valve actuation chamber 94 to move the valve 92 to its open position. Accordingly, the valve 92 is automatically displaced from its rest position of FIG. 4 to its actuated position of FIG. 3, and, thus, the auxiliary fuel and air supply conduit is automatically opened. Then, the user starts the engine such as by pulling a manual start pull cord (not shown) or pressing an electric start button (not shown) as is known to those of ordinary skill in the art.

Thereafter, once the engine is running, the operator actuates the throttle valve 32, which actuation automatically moves the valve 92 to its closed or rest position of FIG. 4 to close off the conduits of the auxiliary fuel and air supply apparatus. More specifically, the shaft 34 rotates and the recess 114 cams against the head 118 of the valve 92 to displace the valve 92 away from the shaft 34. Accordingly, when the valve 92 moves to its closed position, the head 118 of the valve 92 covers or blocks and closes both the air passage 104 and the fuel passage 106.

Therefore, when starting the engine, the operator need not manually actuate a manual control valve to open the conduit of the auxiliary fuel and air supply apparatus. And, when operating the running engine, the operator need not manually actuate a manual control valve to close the auxiliary fuel and air conduit. Rather, the auxiliary fuel and air supply conduit is opened and closed automatically, when the operator performs some other operation such as depressing a purge bulb or actuating a throttle. Accordingly, engine starting and operating is relatively simplified and requires relatively fewer components.

As used in this specification and claims, the terms "for example," "for instance," and "such as," and the verbs "comprising," "having," "including," and their other verb forms, when used in conjunction with a listing of one or more components or other items, are each to be construed as open-ended, meaning that that the listing is not to be considered as excluding other, additional components, elements, or items. Moreover, directional words such as top, bottom, upper, lower, radial, circumferential, axial, lateral, longitudinal, vertical, horizontal, and the like are employed by way of description and not limitation. Other terms are to be construed using their broadest reasonable meaning unless they are used in a context that requires a different interpretation. When introducing elements of the present invention or the embodiments thereof, the articles "a," "an," "the," and "said" are intended to mean that there are one or more of the elements.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

What is claimed is:

1. A carburetor, comprising:

a body having a fuel and air mixing passage with a throttle valve in the fuel and air mixing passage, and a bore with a valve in the bore and defining in part a valve actuation chamber and a separate fuel and air mixing chamber communicating with the fuel and air mixing passage at a location downstream of the throttle valve;

a fuel passage in communication with the fuel and air mixing chamber; and a purge apparatus in communication with the valve actuation chamber and being operable to move the valve within the bore to an open position so that the fuel passage may communicate with the fuel and air mixing chamber and fuel and air may flow from the fuel and air mixing chamber to a location in the fuel and air mixing passage downstream of the throttle valve.

2. The carburetor of claim 1, further comprising an air passage in communication with the fuel and air mixing chamber.

3. The carburetor of claim 2, wherein the air passage is in communication with the fuel and air mixing passage upstream of the throttle valve.

4. The carburetor of claim 1, further comprising a fuel chamber, and a check valve in communication with the fuel passage between the fuel chamber and the fuel and air mixing chamber.

5. The carburetor of claim 1, wherein the valve of the bore includes a seal separating the fuel and air mixing chamber from the valve actuation chamber.

6. The carburetor of claim 1, further comprising a fuel chamber, wherein the purge apparatus includes a purge bulb and a purge valve having an inlet and an outlet, such that repeated depression and release of the purge bulb draws fuel from the fuel chamber through the inlet of the purge valve and into the purge bulb, and expels fuel from the purge bulb through the outlet of the purge valve and into the valve actuation chamber.

7. The carburetor of claim 6, further comprising a return fuel passage in communication with the valve actuation chamber, wherein repeated depression and release of the purge bulb expels fuel from the valve actuation chamber and out of the carburetor through the return fuel passage.

8. The carburetor of claim 1, wherein the valve includes at least one passage therein.

9. The carburetor of claim 8, further comprising a throttle shaft carrying the throttle valve, wherein the throttle shaft includes a passage therein in communication with the at least one passage of the valve.

10. The carburetor of claim 9, further comprising a passage extending between the bore and a location within the fuel and air mixing passage downstream of the throttle valve.

11. An auxiliary fuel and air supply apparatus for a diaphragm carburetor with a fuel and air mixing passage having a throttle valve located therein downstream of an air intake opening of the fuel and air mixing passage, the apparatus comprising:

a bore having a fuel and air mixing valve disposed therein defining in part a valve actuation chamber and a separate fuel and air mixing chamber communicating with the fuel and air mixing passage at a location downstream of the throttle valve;

a fuel chamber;

a fuel passage having an upstream end in communication with the fuel chamber and a downstream end in communication with the fuel and air mixing chamber;

an air passage having an upstream end in communication with the fuel and air mixing passage at a location upstream of the throttle valve and further having a downstream end in communication with the fuel and air mixing chamber;

a return fuel passage having an upstream end in communication with the valve actuation chamber;

a purge passage in communication with the valve actuation chamber; and a fuel chamber purge apparatus including a purge bulb at least partially surrounding a purge valve having an inlet in communication with the fuel chamber and an outlet in communication with the valve actuation chamber via the purge passage, wherein upon actuation of the purge bulb fluid pressure moves the fuel and air mixing valve to communicate the fuel and air mixing passage with the air and fuel passages.

12. The auxiliary fuel and air supply apparatus of claim 11, wherein the fuel and air mixing passage includes a venturi in communication with the fuel chamber.

13. The auxiliary fuel and air supply apparatus of claim 11, wherein the valve of the bore includes a seal separating the fuel and air mixing chamber from the valve actuation chamber.

14. The auxiliary fuel and air supply apparatus of claim 11, further comprising a check valve in communication with the fuel passage between the fuel chamber and the fuel and air mixing chamber.

15. The auxiliary fuel and air supply apparatus of claim 11, wherein the air passage is in communication with the fuel and air mixing passage upstream of the throttle valve.

16. The auxiliary fuel and air supply apparatus of claim 11, wherein the fuel chamber purge apparatus includes a purge bulb and a purge valve having an inlet and an outlet, such that repeated depression and release of the purge bulb draws fuel from the fuel chamber through the inlet of the purge valve and into the purge bulb, and expels fuel from the purge bulb through the outlet of the purge valve and into the valve actuation chamber.

17. The auxiliary fuel and air supply apparatus of claim 16, further comprising a return fuel passage in communication with the valve actuation chamber, wherein repeated depression and release of the purge bulb expels fuel from the valve actuation chamber and out of the carburetor through the return fuel passage.

18. The auxiliary fuel and air supply apparatus of claim 11, wherein the valve includes at least one passage therein.

19. The auxiliary fuel and air supply apparatus of claim 18, further comprising a throttle shaft carrying the throttle valve, wherein the throttle shaft includes a passage therein in communication with the at least one passage of the valve.

20. The auxiliary fuel and air supply apparatus of claim 19, further comprising a fuel and air outlet passage extending between the bore and a location within the fuel and air mixing passage downstream of the throttle valve.

21. A diaphragm carburetor comprising:

a body;

an air inlet in the body;

a fuel and air mixture outlet in the body;

a fuel and air mixing passage through the body between the air inlet and the fuel and air mixture outlet;

a throttle shaft carried by the body, extending across the fuel and air mixing passage, and including a passage therein;

a throttle valve disposed in the fuel and air mixing passage between the air inlet and fuel and air mixture outlet and carried by the throttle shaft;

an auxiliary fuel and air mixing chamber carried by the body;

a fuel metering assembly carried by the body and defining a fuel chamber;

an auxiliary fuel inlet passage in communication with the mixing chamber and the fuel chamber to supply fuel to the mixing chamber;

an auxiliary air inlet passage in communication with the auxiliary fuel and air mixing chamber and the fuel and air mixing passage at a location upstream of the throttle valve to supply air to the auxiliary fuel and air mixing chamber;

an auxiliary fuel and air outlet passage in communication with the auxiliary fuel and air mixing chamber and the fuel and air mixing passage at a location downstream of the throttle valve to supply a mixture of fuel and air from the auxiliary fuel and air mixing chamber to the fuel and air mixing passage;

a valve carried by the body in the auxiliary fuel and air mixing chamber defining in part a valve actuation chamber and being movable to a closed position and an open position to control flow of an auxiliary air and fuel mixture from the auxiliary fuel and air mixing chamber to the fuel and air mixing passage, wherein the valve includes at least one passage therein in communication with the passage in the throttle shaft;

a fuel chamber purge passage in communication with the mixing chamber; and a fuel chamber purge apparatus carried by the body and in communication with the fuel chamber and the fuel chamber purge passage and being operable to move the valve to the open position, wherein the fuel chamber purge apparatus includes a purge bulb and a purge valve having an inlet and an outlet, such that repeated depression and release of the purge bulb draws fuel from the fuel chamber through the inlet of the purge valve and into the purge bulb, and expels fuel from the purge bulb through the outlet of the purge valve, into the valve actuation chamber thereby moving the valve, and ultimately out of the carburetor through a return fuel passage.

* * * * *